United States Patent [19]

Dickinson

[11] Patent Number: 4,971,391

[45] Date of Patent: Nov. 20, 1990

[54] FENCEPOST SEATS

[76] Inventor: Merton H. Dickinson, 1391 Eagle Nest Way, Palm City, Fla. 34990

[21] Appl. No.: 1,180

[22] Filed: Jan. 7, 1987

[51] Int. Cl.[5] ..... A47C 15/00

[52] U.S. Cl. ..... 297/217; 182/187; 211/107; 211/205; 248/218.4

[58] Field of Search ..... 297/217, 463; 108/152; 182/187; 248/219.1, 219.3, 219.4, 218.4; 211/107, 205

[56] References Cited

U.S. PATENT DOCUMENTS

| | | | |
|---|---|---|---|
| 3,205,007 | 9/1965 | Sommer | 248/219.4 X |
| 3,976,273 | 8/1976 | Kussow | 248/218.4 |
| 4,345,526 | 8/1982 | Streit | 211/205 X |

FOREIGN PATENT DOCUMENTS

| | | | |
|---|---|---|---|
| 11416 | 11/1902 | Austria | 182/187 |
| 923871 | 4/1973 | Canada | 248/218.4 |
| 1195651 | 11/1959 | France | 248/219.1 |
| 1494120 | 9/1967 | France | 248/218.4 |
| 292004 | 7/1953 | Switzerland | 248/218.4 |

*Primary Examiner*—Peter R. Brown
*Attorney, Agent, or Firm*—Alvin S. Blum

[57] ABSTRACT

A seating system is disclosed for supporting a seat on fenceposts of a fenced in area such as a tennis court or playground. Hinge pin clamps of the type ordinarily used for mounting a gate on a fence are clamped to fenceposts. Brackets are provided that are entirely supported by the hinge pins in a manner providing support for a seating surface that is bolted to the brackets. A pair of brackets mount upon a single fencepost to support a seat for a single person. A pair of brackets mount upon two spaced apart fenceposts to support a long seat for many persons.

6 Claims, 3 Drawing Sheets

FENCEPOST SEATS

FIELD OF THE INVENTION

This invention relates to seats on brackets and more particularly to seats entirely supported by brackets attached to fenceposts and to the brackets supporting said seats.

BACKGROUND OF THE INVENTION

Seats for spectators within the fenced-in areas of playgrounds, tennis courts, and the like are easily damaged or stolen. Furthermore, they may be moved onto the playing area causing damage to the surface and interfering with the games. It is, therefor, desirable to provide seats for fenced in areas that overcome the disadvantages of the prior art.

SUMMARY OF THE INVENTION

To this end, it is an object of the invention to provide seats that attach to the fenceposts of the fenced-in area, and that are not readily moveable therefrom and that do not encroach upon play area.

It is another object of the invention to provide seats without supports touching the ground to permit maintenance beneath the seats.

It is yet another object to provide seats that are supported by one or more fenceposts.

It is yet another object to provide seats that are easy to install.

It is yet another object to provide seats that are inexpensive to manufacture.

It is yet another object to provide seats that have no support legs to stumble over.

It is yet another object to provide seats that remain close to a fence.

It is yet another object to provide seats that support one or two occupants and are supported by a single fencepost.

It is yet another object to provide seats that support multiple occupants and are supported by two fenceposts.

It is yet another object to provide seats that have support brackets that store in a flat container for economical shipment and storage.

It is yet another object to provide seats that have a horizontal seating surface that is removable for storage when not in use.

It is yet another object to provide seats that have seat supporting brackets with vertically spaced apart pin-receiving means for engaging the pins of hinge pin brackets attached to the fencepost. The brackets have a horizontal member extending out from the pin-receiving means upon which the horizontal seating surface element rests. The horizontal member includes bolt receiving means to receive a bolt or pin securing the seating surface element to the bracket. The brackets are arranged to permit two brackets to be supported by a single post with only two hinge pin brackets, by aligning the pin engaging means coaxially and using a support rod in conjunction with the hinge pins.

Additional objects, features and advantages of the invention will be understood from the following description and accompanying drawings.

DETAILED DESCRIPTION OF PREFERRED EMBODIMENTS

Figure 1:
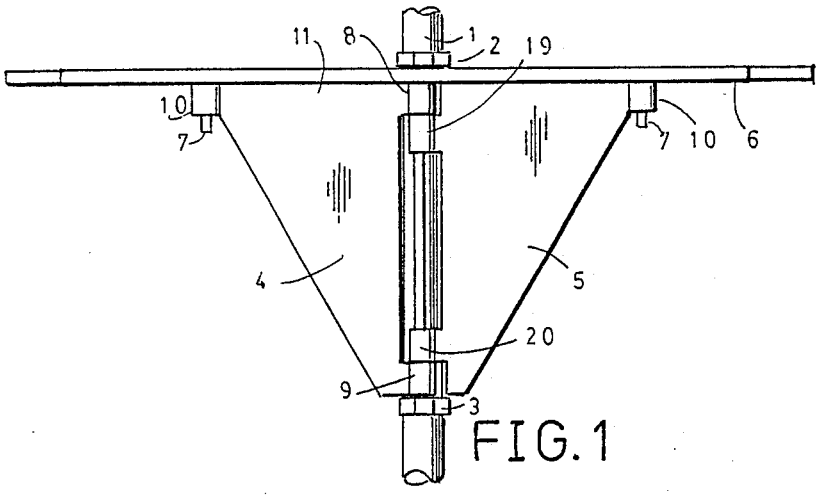
FIG. 1 is a front elevation of a seat in place on one fencepost.
Figure 4:
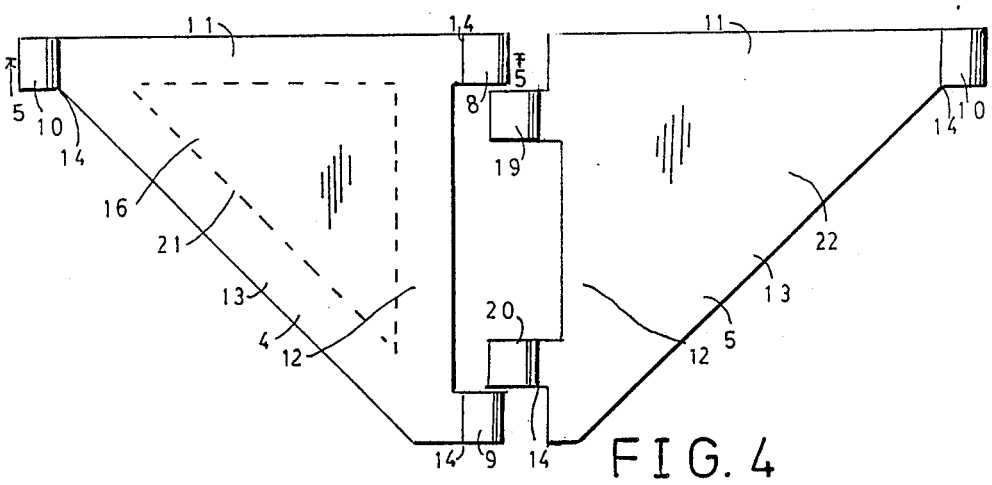
FIG. 4 is a front elevation of a pair of brackets of FIG. 1 lying in a common plane and slightly apart to illustrate interdigitating of engaging means.
Figure 5:
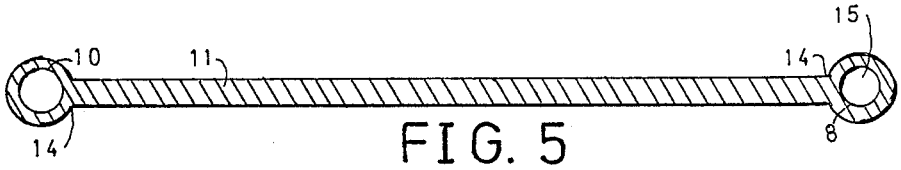
FIG. 5 is a cross section taken on plane 5—5 of the left bracket of FIG. 4.
Figure 6:
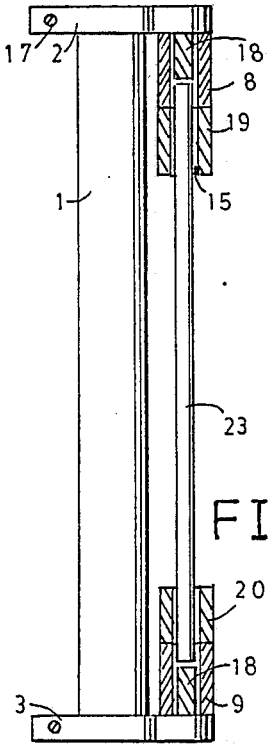
FIG. 6 is a side elevation detail of the support structure of FIG. 1.

A galvanized steel wire mesh fence surrounding a tennis court is usually supported by two and one half inch diameter galvanized steel pipes embedded in the ground (or concrete) and spaced ten feet apart. In FIG. 1, one of these supporting pipes 1 is shown, sans wire mesh, with a flat, horizontal seat 6 supported by the two brackets 4 and 5 that are secured to the pipe by the upper hinge pin clamp 2 and lower hinge pin clamp 3 that are clamped directly to pipe 1. The seat 6 may be a 2 inch thick wooden plank 12 inches wide and 32 inches long. Alternatively it may be a padded seat of more sophisticated structure. Details are shown in FIGS. 3,4,5 and 6. Clamp 2 and 3 surround pipe 1 and are tightly held by bolts 17. The brackets 4 and 5 (FIG. 4) are comprised of substantially triangular aluminum plates 21 and 22 to which the aluminum cylinders 8,9,19 and 20 are welded at weld joints 14. These cylinders have an inner hole 15 to fit the hinge pin 18 of the hinge pin clamps. The hinge pin clamps may be any of the usual type that encircle the post and clamp tightly to the post such as by the bolt 17. They are generally used to provide a vertical pin 18 parallel to the post upon which the hinge of a gate rotates. The cylinders 8 and 9 of the left bracket are engaged by the pins 18 of the hinge pin clamps 2 and 3 shown in detail in FIG. 6 wherein the pins and cylinders are shown in cross section. A galvanized steel rod 23, of the same diameter as pins 18, extends from within upper cylinder 8 to within lower cylinder 9 of bracket 4, maintaining its vertical position. It passes through the upper cylinder 19 and the lower cylinder 20 of the bracket 5, thereby maintaining the vertical position of both brackets with only one pair of hinge pin clamps. Holding each bracket at top and bottom holds the seat 6 flat resisting the rotation forces (torque) about the upper cylinder when force is applied to the distal end of each bracket. The brackets 4 and 5 have cylinders 10 welded to the third angle of the triangle. These cylinders have a hole to receive the seat bolt 7. The seat 6 may have a countersunk hole to receive the bolt 7 while providing a smooth seating surface. The brackets 4 and 5 extend out from the post at approximately 90 degrees to each other. The bracket 4 of FIG. 4 shows an inner triangular space 16 within phantom lines. In alternative embodiment this portion of the plate may be absent. The bracket then comprises a vertical member 12, a horizontal member 11 and a diagonal number 13 where the structural material of the bracket is most usefully concentrated. This might be cast or molded in one piece.

Figure 2:
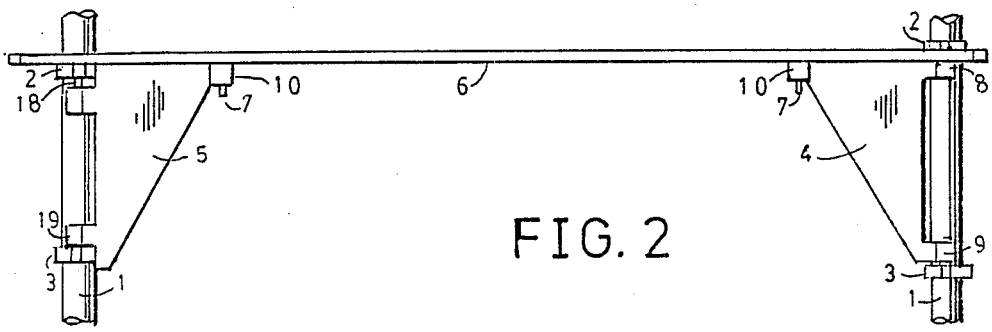
FIG. 2 is a front elevation of a multi-person seat in place on a pair of fenceposts.
Figure 3:
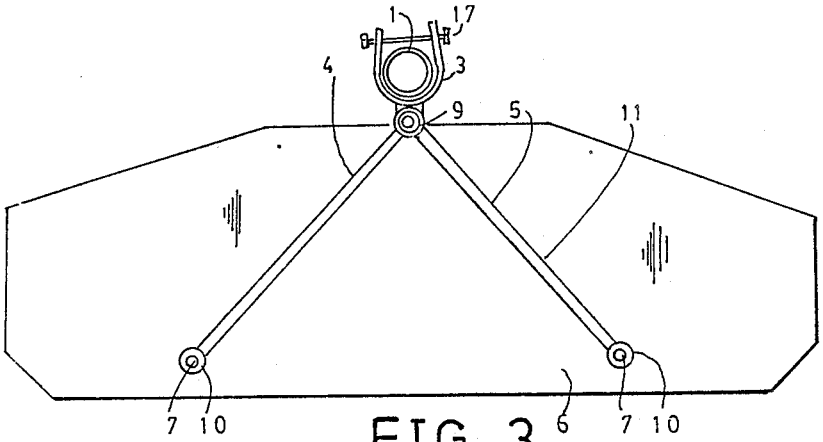
FIG. 3 is a bottom plan view from underneath the seat of FIG. 1.

FIG. 2 shows the brackets 4 and 5 each supported on a separate post 1. This embodiment would be applied to seating a number of persons on the wide plank 6 which might be ten feet long. By positioning the bolts 7 at a distance apart that is different than the spacing between the poles, the seat is prevented from swiveling on the pins.

Figure 9:
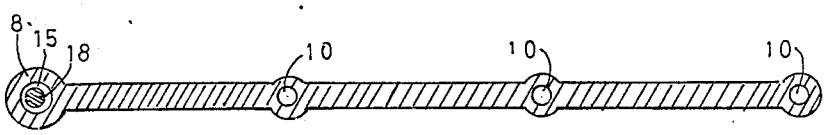
FIG. 9 is a cross sectional view of a bracket with multiple bolt engaging means.

It may be desirable to make the seat 6 from a plurality of narrow planks rather than one wide plank to prevent warping and water accumulation. The bracket shown in FIG. 9 provides a plurality of bolt engaging elements 10 which may be used to secure 3 individual narrow planks to the bracket to form a seat.

Figure 7:
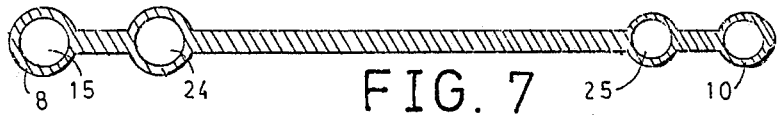
FIG. 7 is a cross section through a profile extrusion useful in manufacturing one embodiment of the bracket.
Figure 8:
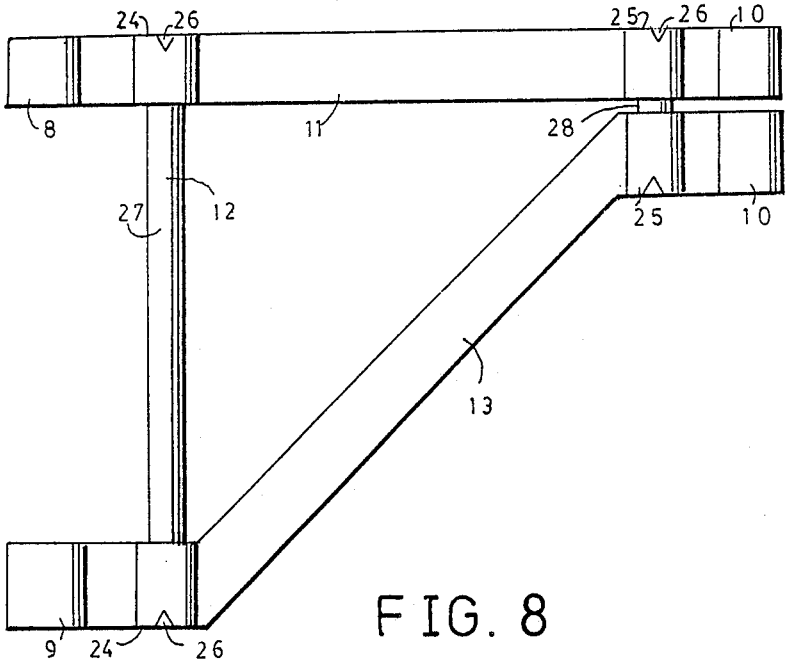
FIG. 8 is a front elevational of a bracket made with the profile extrusion of FIG. 7.

FIGS. 8 and 7 show how the bracket may be prepared from the profile extrusion shown in cross section in FIG. 7. A first portion is cut to form the horizontal member 11 of the bracket. A second portion is cut to form the diagonal member 13. A long bar 27 fits into holes 24 of both cut portions and is crimped in place at crimps 26 to form the vertical member 12. A short bar 28 fits into holes 25 of both cut portions and is crimped in place at crimps 28 to produce a rigid bracket with pin receiving elements 8 and 9 and bolt receiving elements 10.

The brackets may be formed of aluminum, steel or a suitable structurally strong composition such as plastic.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. Seat-supporting brackets for fencepost-supported seats held in place by vertical support pins clamped to said fenceposts, said brackets comprising:

(a) vertical member means including a fixed upper, pin-engaging means and a fixed lower, pin-engaging means for supporting said bracket on said fencepost by said vertical support pins clamped to said fencepost, said pin-engaging means directly connected to said vertical member means;

(b) horizontal member means fixedly connected, at a first end, to the upper end of said vertical member means and extending substantially horizontal therefrom, said horizontal member means including, at a second end, a vertical bolt engaging means, said bolt engaging means for engaging bolt means holding a seating surface means to said bracket and said horizontal member means providing a bearing surface for said seating surface means to rest thereupon;

(c) diagonal member means fixedly connecting the lower end of said vertical member means to said second end of said horizontal member means to maintain said horizontal member means and said seating surface means in a horizontal position under a seating load; said brackets including a first bracket having said pin engaging means arranged on said vertical member means so as to interdigitate with said pin engaging means on said vertical member means of a second bracket, thereby aligning all four of said pin-receiving holes with a common axis.

2. The brackets of claim 1, including means for engaging said upper pin-receiving holes of said first bracket by a first vertical support pin and means for engaging said lower pin-receiving holes of said first bracket by a second vertical support pin and means for engaging, at the same time, said upper and said lower pin-receiving holes by a connecting rod means and further including means for engaging said connecting rod means by both upper and lower pin-receiving holes of said second bracket to support both said first bracket and said second bracket to a single fencepost by means of said first vertical support pin and said second vertical support pin; wherein said connecting rod means is of a length to extend from within said upper pin-receiving hole of said first bracket to within said lower pin-receiving hole of said first bracket to provide support for said second bracket therebetween, said connecting rod means sharing said pin-receiving holes of said first bracket with said vertical support pins.

3. A pair of brackets for mounting a seat upon a single fencepost by vertical pins attached to said fencepost, comprising:

(a) a first bracket including two pin engaging means attached to a first edge of said bracket for engaging two of said vertical pins when said pins are attached vertically spaced apart on said fencepost, thereby supporting said first bracket by said fencepost with said first edge substantially vertical alongside said fencepost, and bolt engaging means attached to a second edge of said first bracket, wherein said second edge is fixed substantially at right angles to said first edge, and extends substantially horizontal when said pins are engaged;

(b) a second bracket including two connecting rod engaging means attached to a first edge of said bracket for engaging a connecting rod means when said connecting rod means is also engaged by both of said pin engaging means of said first bracket while said first bracket is supported by said vertical pins at said fencepost, thereby supporting said second bracket by said fencepost with said first edge substantially vertical, and bolt engaging means attached to a second edge of said second bracket, wherein said second edge is fixed substantially at right angles to said first edge, and extends substantially horizontal when said rod means is engaged;

(c) wherein said second edges of both said brackets provide support surfaces in a substantially horizontal common plane upon which to rest a seating surface means and said bolt engaging means providing means for securing said seating surface means to said brackets by bolt means, and each said pin engaging means of said first bracket provides a pin-receiving hole arranged to engage both one of said vertical pins and said connecting rod means at the same time so that the vertical pins thereby support said first bracket directly and said second bracket indirectly through the agency of said connecting rod means; wherein said connecting rod means is of a length to extend from within said upper pin-receiving hole to within said lower pin-receiving hole of said first bracket to provide support for said second bracket therebetween, said connecting rod means thereby sharing said pin-receiving holes of said first bracket with said vertical pins.

4. The brackets of claim 3 comprised substantially of profile extrusions fixedly joined together.

5. The profile extrusions of claim 4 comprised substantially of thermoplastic material.

6. The profile extrusions of claim 4 comprised substantially of aluminum alloy.

* * * * *